US008450242B2

(12) United States Patent
Majumdar et al.

(10) Patent No.: US 8,450,242 B2
(45) Date of Patent: May 28, 2013

(54) THERMAL TRANSFER DONOR ELEMENT

(75) Inventors: Debasis Majumdar, Rochester, NY (US); Joseph Cashimere, Rochester, NY (US); Yongcai Wang, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 260 days.

(21) Appl. No.: 13/093,913

(22) Filed: Apr. 26, 2011

(65) Prior Publication Data

US 2012/0273122 A1 Nov. 1, 2012

(51) Int. Cl.
*B41M 5/40* (2006.01)

(52) U.S. Cl.
USPC ..... 503/227; 428/32.6; 428/32.76

(58) Field of Classification Search
None
See application file for complete search history.

(56) References Cited

U.S. PATENT DOCUMENTS

| | | | |
|---|---|---|---|
| 5,672,561 | A | 9/1997 | Shinohara |
| RE38,496 | E | 4/2004 | Sawamura et al. |
| 6,855,666 | B2 | 2/2005 | Simpson et al. |
| 7,018,772 | B2 | 3/2006 | Simpson et al. |
| 7,056,551 | B2 | 6/2006 | Lobo et al. |

OTHER PUBLICATIONS

U.S. Appl. No. 12/565,140, filed Sep. 23, 2009 titled "Dye Transferable Material With Improved Image Stability" by W. Vreeland.

*Primary Examiner* — Bruce H Hess
(74) *Attorney, Agent, or Firm* — J. Lanny Tucker

(57) ABSTRACT

A thermal transfer donor element can be used to provide a clear protective overcoat on a thermal image receiver element from a thermal transferable protective clear film on the donor element. This thermal transferable protective clear film includes a transparent poly(vinyl acetal) binder to which are attached silicone groups to improve scratch resistance of the transferred protective overcoat. Such protective overcoats can also be applied over thermally transferred dye images.

20 Claims, No Drawings

THERMAL TRANSFER DONOR ELEMENT

FIELD OF THE INVENTION

This invention relates to a thermal transfer donor element that can provide a clear film (such as a protective overcoat) to a thermal receiver element using thermal transfer. This invention also relates to an assembly having the thermal transfer donor element in thermal association with a thermal receiver element.

BACKGROUND OF THE INVENTION

There are many ways of forming an image. Images can be formed through thermal transfer of dyes, inkjet applications, electrophotographic reproduction, and silver halide image development.

To form any printed image, the image is either chemically developed from film, or developed from an electronic signal generated from either a digital capture device, or scanning of a film. For thermal, inkjet, and electrophotographic prints, electronic signals indicating appropriate colors are used to produce cyan, magenta, yellow, and black color signals. These signals are then transmitted to a printer where colored material is transferred to a receiver element. A color hard copy is thus obtained that corresponds to the original image.

Thermal transfer prints are susceptible to re-transfer of colorants to adjacent surfaces, to discoloration by fingerprints because the colorants remain at the surface of the receiver element, and to scratches during imaging and handling. Heat can be used to drive the colorants deeper into the receiver element. Application of a protective overcoat on these types of color images is also known, and effectively reduces these problems. The protective overcoat can also provide improved light stability if a UV absorbing compound is incorporated in the formulation.

In a thermal dye transfer printing process, it is desirable for the finished thermal dye prints to compare favorably with color photographic prints in terms of image quality. The look and feel of the final color prints in vary dependent upon the surface texture and gloss. Typically, color photographic prints are available in surface finishes ranging from very smooth, high gloss to rougher, low glass matte finishes.

A clear protective layer can be transferred to a dye image to give the desired protection and finish as described for example in U.S. Pat. Nos. 6,855,666 (Simpson et al.), 7,018,772 (Simpson et al.), and 7,056,551 (Lobo et al.) and Reissue U.S. Pat. No. 38,496 (Sawamura et al). This clear protective layer can be provided as the sole transferrable material in a thermal transfer donor element, or it can be one of multiple patches, some of which include thermal transferable dyes. In either instance, there is a need to provide a clear protective layer that has optimal scratch resistance during manufacture, imaging, and handling of the thermal transfer donor element and the final image print.

There is a need to utilize the benefit of silicones to improve scratch resistance of the protective overcoats provided in image prints obtained from thermal transfer.

SUMMARY OF THE INVENTION

This invention provides a thermal transfer donor element comprising a polymeric support having at least a portion thereof coated with a thermal transferable protective clear film that comprises a transparent poly(vinyl acetal) binder to which is attached silicone groups.

This invention also provides a method for providing a protective overcoat on a thermal dye transfer receiver element comprising:

bringing the thermal transfer donor element of this invention into thermal association with a thermal dye transfer receiver element, and thermally transferring the thermal transferable clear film from the thermal transfer donor element to the thermal dye transfer receiver element.

In some embodiments, this method further comprises:

thermally transferring a dye image from a thermal transfer donor element comprising at least one thermal image dye patch, and the thermal transferable clear film is thermally transferred over the thermally transferred dye image to provide a protective overcoat.

The thermal transfer donor element of this invention can be used in a thermal transfer assembly in thermal association with a receiver element that can be a thermal dye transfer receiver element or a different element that can receive the thermal transferable clear film but which is not designed for receiving dye images. For example, such non-thermal dye transfer receiver elements can be display devices prepared from various compositions (including display devices having organic light-emitting diodes), or substrates having applied inks or images. The thermal transferable clear films can be transferred to such elements to provide protective overcoats.

For example, in such embodiments of this invention a method for providing a protective overcoat on a receiver element comprises:

bringing the thermal transfer donor element of this invention into thermal association with a receiver element, thermally transferring the thermal transferable clear film from the thermal transfer donor element to the receiver element.

By attaching silicone moieties to polymeric binders used to prepare thermally transferable protective overcoats, improved scratch resistance for the thermally transferred color images is obtained when the protective overcoat is applied to the transferred dyes. Because the silicone is bound to the polymer, it does not migrate out of the overcoat.

DETAILED DESCRIPTION OF THE INVENTION

Unless otherwise indicated, the terms "thermal transfer donor element" or "donor element" are used herein to refer to embodiments of the present invention. Such donor elements can be used to transfer during the application of thermal energy (or heat) a transparent protective overcoat (sometimes known in the art as a "laminate") as well as one or more different dye images. As used in this invention, the "thermally transferable protective clear film" that can form a transparent protective overcoat can also be referred to as a "heat transferable material". Other heat transferable materials can provide dye images.

Unless otherwise indicated, the terms "thermal transferable protective clear film", "protective overcoat", and "protective clear film" refer to the same feature.

The donor element comprises a polymeric support (described below) having at least a portion thereof coated with one or more heat transferable materials wherein at least one of those heat transferable materials is the thermally transferable protective clear film described in more detail below.

Support

Any material can be used as the support for the donor elements provided it is dimensionally stable and can withstand the heat of thermal transfer, for example from a thermal printing head. Suitable materials can include but are not limited to, polyesters such as poly(ethylene terephthalate) and poly(ethylene naphthalate), polyamides, polycarbonates, glassine paper, condenser paper, cellulose esters such as cellulose acetate, fluorine polymers such as poly(vinylidene fluoride) or poly(tetrafluoroethylene-co-hexafluoropropylene), polyethers such as polyoxymethylene, polyacetals, polyolefins such as polystyrene, polyethylene, polypropylene or methylpentene polymers, and polyimides such as polyimide amides and polyetherimides. The support can have a thickness of at least 2 μm and up to and including 30 μm, although thicker or thinner supports could be used for specific applications. According to certain embodiments where a high gloss image is desired, the support can have a surface roughness, Ra, of about 18 nm or less on the side of the support on which the heat transferable material is provided. The support can include a black ink or various pigments to provide reflectance or desired tints.

Heat Transferable Materials

The heat transferable material can be provided in one or more sections, or patches, on the donor element, or the heat transferable material can be coated on the entire surface or length (if in the form of a web or ribbon) of the donor element. The donor element can be provided as sheets, rolls, webs, or ribbons of any desired width and length suitable for the intended thermal transfer apparatus. Thus, the resulting images can be provided in various sizes and dimensions. The patches or sections of heat transferable materials on a donor element can be the same or different, and can be in a repeating pattern if desired. For example, typical dye patch colors include yellow, cyan, and magenta, although black, white, metallics (such as aluminum or copper), and secondary and tertiary colors can be also provided in a dye patch. The donor element can also include only a thermal transferable protective clear film, or it can also include a single thermal transferable dye (for example as dye patches). Thus, a donor element can include two or more desired colored dye patches in a given sequence with a protective overcoat patch (thermal transferable protective clear film), or a single color dye patch followed by a protective overcoat patch. The sequence can repeat, if desired. An exemplary sequence commonly used in thermal dye diffusion printing is a repeat of yellow, magenta, cyan, and protective overcoat (clear film) patches. In many embodiments, the donor element comprises a poly(ethylene terephthalate) support having at least the protective overcoat patch and one or more dye patches.

The donor element includes one or more non-heat transferable polymeric binders in the heat transferable dye material. Such polymeric binders are known for use in dye diffusion thermal transfer media. Heat transferable polymeric binders are generally not present in the dye image-forming heat transferable materials since it is desired that essentially only the dye(s) and any stabilizers are transferred. However, as noted below, the heat transferable materials that provide transparent clear films generally contain heat transferable polymeric binders.

In some embodiments of the invention, the donor element is a monochrome element and comprises two repeating sections or patches, the first section comprising a layer of an image dye dispersed in a polymeric binder, and the second section comprising a protective clear film.

In yet other embodiments of the invention, the donor element is a black-and-white element and comprises two repeating sections or patches, the first section comprising a layer of a mixture of image dyes dispersed in a non-heat transferable polymeric binder to produce a neutral color and the second section comprising a protective clear film.

Other embodiments of this invention include thermal transfer donor elements that further comprise one or more patches of thermal yellow, cyan, magenta, or black image dyes dispersed within a polymeric binder, as well as patches comprising a thermal transferable protective clean film. In other embodiments, the thermal transfer donor elements comprise at least one patch of each of the thermal yellow, cyan, magenta, and black image dyes, and at least one patch of the thermal transferable clear film.

Dye-Containing Heat Transferable Materials

Any ink or dye can be used in the donor element provided that it is transferable to the thermal dye image receiving layer by the action of heat. These aspects of the donor elements are described, for example, in U.S. Pat. Nos. 4,916,112 (Henzel et al.), 4,927,803 (Bailey et al.), and 5,023,228 (Henze') that are all incorporated herein by reference. Forming a dye transfer image generally include imagewise heating a dye-containing heat transferable material to either or both sides of a thermal dye receiver element. Especially good results have been obtained with diffusible dyes, such as the magenta dyes described in U.S. Pat. No. 7,160,664 (Goswami et al.) that is incorporated herein by reference.

The dye donor layer can include a single color area (patch) or multiple colored areas (patches) containing dyes suitable for thermal printing. As used herein, a "dye" can be one or more dyes, pigments, colorants, or a combination thereof, and can optionally be in a binder or carrier as is known to practitioners in the art. For example, the dye layer can include a magenta dye combination and further comprise a yellow dye-donor patch comprising at least one bis-pyrazolone-methine dye and at least one other pyrazolone-methine dye, and a cyan dye-donor patch comprising at least one indoaniline cyan dye.

The dye can be selected by taking into consideration hue, light-fastness, and solubility of the dye in the dye donor layer binder and the thermal dye image receiving layer binder.

Further examples of useful dyes for various color images can be found in U.S. Pat. Nos. 4,541,830 (Hotta et al.), 4,698,651 (Moore et al.), 4,695,287 (Evans et al.), 4,701,439 (Evans et al.), 4,757,046 (Byers et al.), 4,743,582 (Evans et al.), 4,769,360 (Evans et al.), 4,753,922 (Byers et al.), 4,910,187 (Sato et al.), 5,026,677 (Vanmaele), 5,101,035 (Bach et al.), 5,142,089 (Vanmaele), 5,374,601 (Takiguchi et al.), 5,476,943 (Komamura et al.), 5,532,202 (Yoshida), 5,804,531 (Evans et al.), 6,265,345 (Yoshida et al.), and 7,501,382 (Foster et al.), and U.S. Patent Application Publications 2003/0181331 (Foster et al.) and 2008/0254383 (Soejima et al.), the disclosures of which are hereby incorporated by reference. Other useful dyes, especially magenta, yellow, and cyan dyes and combinations of two or more of each color dye, are described in U.S. Patent Application Publication 2011/0067804 (Vreeland) that is incorporated herein by reference.

The dyes can be employed singly or in combination to obtain a monochrome dye-donor layer or a black dye-donor layer. The dyes can be used in an amount of at least 0.05 $g/m^2$ and up to and including 2 $g/m^2$ of coverage.

Each dye donor layer can include one or more dyes at a coverage of at least 20 weight % and up to and including 90 weight % dye, relative to the total dry weight of all components in the layer. The dye percent is ideally chosen in view of the specific donor element and dye receiver element combination. Varying the amount of dye in the donor element can aid in matching the efficiency between different dye patches, for example, a cyan, magenta, and yellow patch.

To form each color patch of a dye donor layer, one or more dyes can be dispersed in a non-heat transferable polymeric binder. Such polymeric binders can be used in an amount of at least 0.05 g/m$^2$ and up to and including 5 g/m$^2$. The polymeric binder can be, for example, a polycarbonate, a polyester, a poly(styrene-co-acrylonitrile), a poly(sulfone), a poly(phenylene oxide), a cellulose derivative including but not limited to cellulose acetate, cellulose acetate propionate, cellulose acetate butyrate, or cellulose triacetate, or a combination of these polymers. Typically, the polymeric binder is a cellulose ether or ester, for example, ethyl cellulose.

The dye-containing layers (or patches) can also include one or more compounds used to provide light stability. Various compounds for this purpose are known in the art including but not limited to, nickel complexes, hindered amine light stabilizers, and N-oxyl radicals derived from hindered amines. Such compounds are described for example in U.S. Pat. Nos. 4,855,281 (Byers), 7,301,012 (Fujiwara), and 7,384,138 (Taguchi), all of which are incorporated herein by reference, as well as U.S. Patent Application Publication 2011/0067804 (noted above). The N-oxyl radicals having a molecular weight of 600 or less and defined by Formula III in U.S. Pat. No. '804 are particularly useful to stabilize transferred cyan dye images. Useful amounts of the light stabilizers are at least 1 mg/m$^2$ and up to and including 35 mg/m$^2$, and the amounts can be the same or different for the various dye patches and clear protective overcoat.

The dye donor layers and thermal transferable protective clear films in the donor elements can also include particulate materials in an amount of at least 0.1 weight % based on the layer dry weight. For example the dye donor layers and clear films can include crosslinked elastomeric organic beads that can have a glass transition temperature (Tg) of 45° C. or less. The elastomeric beads can be made from an acrylic polymer or copolymer, such as butyl-, ethyl-, propyl-, hexyl-, 2-ethylhexyl-, 2-chloroethyl-, 4-chlorobutyl- or 2-ethoxyethyl-acrylate or methacrylate, acrylic acid or methacrylic acid, hydroxyethyl acrylate, a styrenic copolymer, such as styrene-butadiene, styrene-acrylonitrile-butadiene, styrene-isoprene, or hydrogenated styrene-butadiene, or mixtures thereof. The elastomeric beads can be crosslinked with various crosslinking agents, which can be part of the elastomeric copolymer, including but not limited to divinylbenzene, ethylene glycol diacrylate, 1,4-cyclohexylene-bis(oxyethyl) dimethacrylate, 1,4-cyclohexylene-bis(oxypropyl) diacrylate, 1,4-cyclohexylene-bis(oxypropyl) dimethacrylate, and ethylene glycol dimethacrylate. The elastomeric beads can have at least 1% and up to and including 40% by weight of a crosslinking agent. The elastomeric microbeads can be used in any amount effective for the intended purpose. In general, good results have been obtained using a coverage of at least 2 mg/m$^2$ and up to and including 25 mg/m$^2$. The elastomeric microbeads generally have a particle size of at least 4 μm and up to and including 10 μm. The beads should be used at a coverage that is not detrimental to gloss but is beneficial for finishing operations involving web-transport and spool winding.

The elastomeric beads can be crosslinked with various crosslinking agents, which may also be part of the elastomeric copolymer, such as divinylbenzene, ethylene glycol diacrylate, 1,4-cyclohexylene-bis(oxyethyl) dimethacrylate, 1,4-cyclohexylene-bis(oxypropyl) diacrylate, 1,4-cyclohexylene-bis(oxypropyl) dimethacrylate, and ethylene glycol diacrylate.

The glass transition temperatures for the elastomeric beads can be determined by the method of differential scanning calorimtry (DSC) at a scanning rate of 20° C./minute and the onset in the change in heat capacity is taken as the Tg.

The dye donor layer can also include non-elastomeric beads that can have a particle size of at least 0.5 μm and up to and including 20 μm. These beads can act as spacer beads under the compression force of a wound up dye donor roll, improving raw stock keeping of the dye donor roll by reducing the material transferred from the dye donor layer to the slipping layer, as measured by the change in sensitometry under accelerated aging conditions, or the appearance of unwanted dye in the protective overcoat layer, or from the backside of the dye donor element, for example, a slipping layer, to the dye donor layer. The use of the beads can result in reduced mottle and improved image quality. The beads can be employed in any amount effective for the intended purpose, for example at a coverage of at least 0.003 and up to and including 0.20 g/m$^2$. Beads suitable for the dye donor layer can also be used in the slip layer.

The dye donor element can also include a stick preventative agent to reduce or eliminate sticking between the dye donor element and the dye image-receiver element during printing. The stick preventative agent can be present in any layer of the dye donor element, so long as the stick preventative agent is capable of diffusing through the layers of the dye donor element to the dye donor layer, or transferring from the slip layer to the dye donor layer. For example, the stick preventative agent can be present in one or more patches of the dye donor layer, in the support, in an adhesive layer, in a dye-barrier layer, in a slip layer, or in a combination thereof. According to various embodiments, the stick preventative agent can be in the slip layer, the dye donor layer, or both. According to some embodiments, the stick preventative agent is in the dye donor layer. The stick preventative agent can be in one or more colored patches of the dye donor layer, or a combination thereof. If more than one dye patch is present in the dye donor layer, the stick preventative agent can be present in the last patch of the dye donor layer to be printed, typically the cyan layer. However, the dye patches can be in any order. For example, if repeating patches of cyan, magenta, and yellow are used in the dye donor element, in that respective order, the yellow patches, as the last patches printed in each series, can include the stick preventative agent. The stick preventative agent can be a silicone- or siloxane-containing polymer. Suitable polymers can include graft copolymers, block polymers, copolymers, and polymer blends or mixtures. Suitable stick preventative agents are described, for example, in U.S. Pat. No. 7,067,457 (Foster et al.) that is incorporated herein by reference.

Release agents as known to practitioners in the art can also be added to the dye donor element, for example, to the dye donor layer, the slip layer, or both. Suitable release agents can include, for example, those described in U.S. Pat. Nos. 4,740,496 (Vanier) and 5,763,358 (Kaszczuk et al.) that are incorporated herein by reference.

The dye donor layer of the heat-transferable dye donor element can be formed or coated on a support. The dye donor layer composition containing dye(s), non-heat transferable binder, and optional additives can be dissolved in a solvent for coating purposes. The dye donor layer can be formed or coated on the support by techniques such as, but not limited to, gravure process, spin-coating, solvent-coating, extrusion-coating, spray-coating, or other methods known to practitioners in the art.

According to various embodiments, a subbing layer, for example, an adhesive or antistatic tie layer, a dye-barrier layer, or a combination thereof, can be coated between the support and the dye donor layer. The subbing layer can comprise one or more layers. Useful subbing layers are described in U.S. Pat. Nos. 4,695,288 (Ducharme) and 4,737,486 (Kaszczuk et al.) that are incorporated herein by reference.

The adhesive or tie layer can be present to adhere the dye donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities. A dye-barrier layer can be employed in the donor elements to improve the density of the transferred dye. Such dye-barrier layer materials include hydrophilic materials such as those described and claimed in U.S. Pat. No. 4,716,144 (Vanier et al.).

A slip layer can be used on the back side of the heat transferable donor element of the invention (on the support opposite the thermal transferable protective clear film) to prevent the printing head from sticking to it. Such a slip layer can comprise either a solid or liquid lubricating material or mixtures thereof, with or without a polymeric binder or a surface-active agent. Useful lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols). Suitable polymeric binders for the slip layer include poly(vinyl alcohol-co-butyral), poly(vinyl alcohol-co-acetal), polystyrene, poly(vinyl acetate), cellulose acetate butyrate, cellulose acetate propionate, cellulose acetate, and ethyl cellulose.

For example, the slip layer formulation can incorporate a synergistic combination of lubricants from a friction perspective and in terms of headwear or print head buildup, as disclosed in U.S. Pat. No. 7,078,366 (Foster et al.) that is incorporated herein by reference. The slip layer can comprise a maleic anhydride polyethylene graft copolymer and at least one other hydrocarbon wax. A lubricating material can comprise a solid polymer derived from a polyolefin and an ethylenically unsaturated carboxylic acid or ester or anhydride thereof, and at least one wax. The polymer can be an alpha-olefin maleic anhydride copolymer, a maleic anhydride polyethylene graft copolymer, and a copolymer of an α-olefin and isopropyl maleate. The polyolefin is derived from an α-olefin containing between about two to about eight carbon atoms, preferably where the α-olefin is ethylene and/or propylene. The ethylenically unsaturated carboxylic acids are those having between about 3 and 12 carbon atoms. The ethylenically unsaturated carboxylic acid, ester or anhydride may be, for example, maleic acid, ethylmaleic acid, propylmaleic acid, isopropyl maleic acid, fumaric acid, methylenemalonic acid, glutaconic acid, itaconic acid, methylitaconic acid, mesacomic acid, citraconic acid, or a mixture thereof, as well as corresponding esters, anhydrides or mixtures of such acids, esters and anhydrides. The other wax can be an olefinic wax, a saturated hydrocarbon polymer, a linear low molecular weight polyethylene, a branched hydrocarbon with a number average molecular weight of no more than about 10,000 and a melting point or softening point of no more than about 120° C., or a synthetic wax comprising a saturated or unsaturated hydrocarbon. The other wax can be selected from, for example, a mineral wax, a vegetable wax, an animal wax or a synthetic wax that is a saturated or unsaturated hydrocarbon polymer. The ratio of the first wax to the other wax is generally from 5:1 to 1:10. Typically, the slip layer comprises at least three different waxes, the polymer derived from the polyolefin and the ethylenically unsaturated carboxylic acid or ester or anhydride thereof, a highly branched α-olefin polymer, and at least one other wax. This slip layer formulation for resistive head thermal media incorporates a synergistic combination of lubricants from a friction perspective and in terms of headwear buildup.

The amount of lubricating material used in the slip layer is dependent, at least in part, upon the type of lubricating material, but can be in the range of at least 0.001 2 g/m$^2$ and up to and including 2 g/m$^2$. If a polymeric binder is used, the lubricating material can be present in a range of at least 0.1 weight % and up to and including 50 weight % of the polymeric binder.

Any binder can also be used in the slip layer provided it will be useful for the intended effect. In some embodiments, polymeric thermoplastic binders are employed, including, for example, poly(styrene-co-acrylonitrile) (70/30 weight ratio), poly(vinyl alcohol-co-butyral) (available commercially as Butvar® 76® from Monsanto Corp.), poly(vinyl alcohol-co-acetal), poly(vinyl alcohol-co-benzal), polystyrene, poly(vinyl acetate), cellulose acetate butyrate, cellulose acetate propionate, cellulose acetate, ethyl cellulose, cellulose triacetate, poly(methyl methacrylate), and copolymers of methyl methacrylate. In another embodiment, the thermoplastic binder is cellulose acetate propionate or polyvinyl acetal.

Thermal Transferable Protective Clear Films

These protective clear films include one or more poly(vinyl acetal) binders, and at least one of those binders has silicone groups attached to the polymeric backbone. In some embodiments, all of the poly(vinyl acetal) binders in the protective clear films have silicone groups attached to the polymeric backbone. These silicone groups are attached by reacting hydroxyl groups in the poly(vinyl acetal) with an isocyanate-functionalized silicone. A skilled worker in the art would know how this reaction can be achieved, and what reactive isocyanate-functionalized silicones can be used. These silicones are not purposely added to the protective clear films in un-attached form.

For example, the clear film can comprises a transparent poly(vinyl acetal) binder to which is attached silicone groups. A poly(vinyl acetal) binder having at least one hydroxyl group along the backbone is reacted with an isocyanate-functionalized silicone to form a silicone that is attached to the binder backbone though this reaction product. The isocyanate-functionalized silicone has at least one reactive isocyanate group having the Structure:

Many isocyanate-functionalized silicones that are useful for making the noted polymeric binders comprise two or more of reactive isocyanate groups.

For example, the poly(vinyl acetal) binder can comprise a silicone that is attached to the polymer backbone through the reaction product of a hydroxyl group and an isocyanate-functionalized silicone that is represented by one or more of the following Structures (SILICONE$_1$), (SILICONE$_2$), and (SILICONE$_3$):

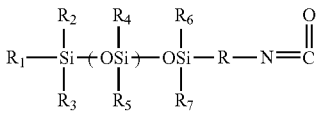

(SILICONE$_1$)

-continued

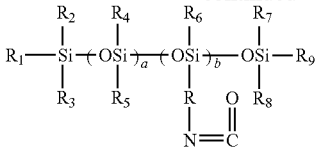

(SILICONE$_2$)

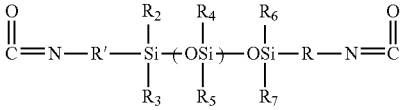

(SILICONE$_3$)

wherein R and R' are the same or different aliphatic linking groups. Such aliphatic linking groups can include substituted or unsubstituted alkylene groups, substituted or unsubstituted cycloalkylene groups, substituted or unsubstituted oxyalkylene groups, and combinations thereof, and any of these groups can be interrupted with oxy, carbonyl, carbonyloxy, carbonamido, urethane, and thiol groups.

$R_1$ through $R_9$ are the same or different substituted or unsubstituted alkyl (branched or linear, and from 1 to 12 carbon atoms in the chain), substituted or unsubstituted cycloalkyl (having 5 to 10 carbon atoms in the cyclic ring), or substituted or unsubstituted phenyl groups.

In the noted Structure SILICONE$_2$, a and b are independently integers of 1 to 2,000, and typically from 1 to 1,000.

These reactive silicone-containing compounds can be formed from the reaction of a suitable isocyanate with a silicone compound having reactive hydroxy groups. Some of these compounds are available commercially, for example as Silmer NCO Di 50 from Siltech Corporation.

To form the polymer useful in the protective clear film, the silicone-containing compound is reacted with pendant hydroxy groups in the poly(vinyl acetal) for example using a catalyst such as dibutyl tin dilaurate at a suitable temperature (for example at least 30° C. or more typically at least 75° C.). The polymer can be purified by removing trace amounts of free silicone materials that are unattached to the poly(vinyl acetal).

The poly(vinyl acetal) binder having attached silicone groups is generally present in the thermal transferable protective clear film in an amount of at least 1 weight % and up to and including 100 weight % and typically in an amount of at least 15 weight % and up to and including 75 weight %. Mixtures of such binders can be present in which each poly (vinyl acetal) has different silicone groups attached to the polymer backbone.

The thermal transferable protective clear film can further comprise: (a) an UV-absorbing light stabilizer that is a hydroxyphenyl triazine or an N-oxyl radical that is derived from a hindered amine (as described above), (b) a plasticizer, (c) a secondary polymeric binder that do not adversely affect the thermal transferability of the thermal transferable protective clear film, (d) a surfactant, (e) an inorganic or organic particulate material, (f) inorganic or organic beads, or (g) any combination of (a) through (f). Mixtures of any of these addenda can also be used. The thermal transferable protective clear film can also include various particulate materials as described above for the dye donor layers.

Other addenda that can be incorporated in the thermal transferable protective clear film include antistatic agents, plasticizers, additional UV absorbers, release agents, defoamers, coating aids, charge control agents, thickeners or viscosity modifiers, antiblocking agents, coalescing aids, crosslinking agents or hardeners, soluble or solid particle dyes, adhesion promoting agents, bite solvents or chemical etchants, lubricants, antioxidants, stabilizers, colorants or tints, fillers, and other materials well-known in the art.

The thermal transferable protective clear film can also comprise one or more secondary polymeric binders that are selected from the group consisting of poly(vinyl benzal), poly(vinyl formal), poly(methyl methacrylate), and a styrene-allyl alcohol copolymer.

As noted above, the thermal transferable protective clear film can be thermally transferred to a thermal dye receiver element just like the dye layers can be transferred.

Thermal Dye Receiver Elements

A dye image receiving element that can be used with the thermal transfer donor element of the invention usually comprises a support having thereon a dye image receiving layer. The support for the dye image receiving layer can be transparent or reflective. The support can be a transparent film such as a poly(ether sulfone), a polyimide, a cellulose ester such as cellulose acetate, a poly(vinyl alcohol-co-acetal), or a poly (ethylene terephthalate). Opaque reflective supports can include plain paper, coated paper, synthetic paper, photographic paper support, melt-extrusion-coated paper, and laminated paper, such as biaxially oriented support laminates. Biaxially oriented support laminates suitable for use as receivers are described for example in U.S. Pat. Nos. 5,853,965 (Haydock et al.), 5,866,282 (Bourdelais et al.), 5,874,205 (Bourdelais et al.), 5,888,643 (Aylward et al.), 5,888,681 (Gula et al.), 5,888,683 (Gula et al.), and 5,888,714 (Bourdelais et al.), all incorporated herein by reference. Biaxially oriented supports can include a paper base and a biaxially oriented polyolefin sheet, for example, polypropylene, laminated to one or both sides of the paper base. The support can be a baryta-coated paper, white polyester (polyester with white pigment incorporated therein), an ivory paper, a condenser paper, or a synthetic paper, for example, DuPont Tyvek® by E.I. DuPont de Nemours and Company (Wilmington, Del.). The support can be used at any desired thickness, for example, at least 10 μM and up to and including 1000 μm. Exemplary supports for the dye image-receiving layer are disclosed in U.S. Pat. Nos. 5,244,861 (Campbell et al.) and 5,928,990 (Guistina et al.) and EP 671,281 (Campbell et al.), all incorporated herein by reference. The support can be a composite or laminate structure comprising a base layer and one or more additional layers. The base layer can comprise more than one material, for example, a combination of one or more of a microvoided layer, a foamed layer, a layer with hollow particles, a non-voided layer, a synthetic paper, a natural paper, and a polymer.

The dye image-receiving layer can comprise, for example, a polycarbonate, a polyurethane, a polyester, poly(styrene-co-acrylonitrile), poly(caprolactone), vinyl-series resins, such as halogenated polymers (for example, polyvinyl chloride and poly(vinylidene chloride)), poly(vinyl acetate), ethylene-vinyl acetate copolymer, vinyl chloride-vinyl acetate copolymer, or mixtures thereof. Latex polymers can be used in the dye image-receiving layer. The latex polymer can be a dispersion in which hydrophobic polymers comprising a monomer unit of, for example, water-insoluble vinyl chloride dispersed as fine particles in a water-soluble dispersion medium. The dispersed state can be one in which polymer is emulsified in a dispersion medium, one in which polymer underwent emulsion polymerization, one in which polymer underwent micelle dispersion, one in which polymer molecules partially have a hydrophilic structure. For such latex polymers it is desirable to prepare the dye image-receiving layer by applying an aqueous type coating solution and then drying it. Exemplary aqueous coating formats are disclosed in U.S. Patent Application Publication 2008/0254241 (Haraguchi et al.). The dye image-receiving layer can be present in any amount that is effective for the intended purpose. In general, good results can be obtained at a concentration of at least 1 $g/m^2$ and up to and including 5 $g/m^2$. Details of useful polymers and supports for the dye image-receiving element are provided for example in U.S. Pat. No. 7,514,028 (Kung et al.) that is incorporated herein by reference.

The dye image-receiving layer generally includes one or more plasticizers in an amount of up to 100 weight % based on total layer polymer weight. Generally, the amount of plasticizer is at least 4% and up to and including 30% based on the total polymer weight. Useful plasticizers include but are not limited to, aliphatic esters such as monomeric and polymeric esters such as ditridecyl phthalate, dicyclohexyl phthalate, dioctylsebacate, polycaprolactone, poly (butylene adipate), and poly(hexamethylene sebacate), as well as others described in U.S. Pat. Nos. 4,871,715 (Harrison et al.) and 6,291,396 (Bodem et al.).

Other optional additives in the dye image-receiving layer include stabilizers such as phosphorus-containing stabilizers (for example, phosphorous acid, an organic diphosphite, a phosphate, an alkyl phosphate, an aryl phosphate, an inorganic phosphate, a phosphoric acid ester, and a phosphorous acid ester) and dialkyl esters (such as dioctyl sebacate) or combinations thereof, release agents such as a modified polydimethylsiloxane, and α-tocophenol or derivatives thereof, as described for example in U.S. Pat. No. 7,514,028 (Kung et al.). Other release agents include silicone or fluorine based compounds as disclosed, for example, in U.S. Pat. Nos. 4,820,687 (Kawasaki et al.) and 4,695,286 (Vanier et al.), the disclosures of which are incorporated herein by reference.

Additional polymeric layers can be present between the support and the dye image-receiving layer. The additional layers can provide coloring, adhesion, antistatic properties, act as a dye-barrier, act as a dye mordant layer, or a combination thereof. For example, a polyolefin such as polyethylene or polypropylene can be present. White pigments such as titanium dioxide or zinc oxide can be added to the polymeric layer to provide reflectivity.

A subbing layer can be used over the polymeric layer in order to improve adhesion to the dye image-receiving layer. This can be an adhesive or tie layer. Exemplary subbing layers are disclosed in U.S. Pat. Nos. 4,748,150 (Vanier et al.), 4,965,238 (Henzel), 4,965,239 (Henzel), and 4,965,241 (Henzel et al.) that are incorporated herein by reference. An antistatic layer as known to practitioners in the art can also be used in the receiver element. The receiver element can also include a backing layer. Suitable examples of backing layers include those disclosed in U.S. Pat. Nos. 5,011,814 (Harrison) and 5,096,875 (Martin) that are incorporated herein by reference.

The dye image-receiver element can also include stick preventative agents, as described for the thermal transfer donor element. The dye image-receiver element and thermal transfer donor element can include the same stick preventative agent.

The dye image-receiving layer can be formed on the support by any method known to practitioners in the art, including but not limited to printing, solution coating, dip coating, and extrusion coating. When the dye image-receiving layer is extruded, the process can include (a) forming a melt comprising a thermoplastic material, (b) extruding or co-extruding the melt as a single-layer film or a layer of a composite (multilayer or laminate) film, and (c) applying the extruded film to the support for the receiver element. Exemplary extruded receiving layer formats are disclosed in U.S. Pat. Nos. 7,125,611 (Kung et al.), 7,091,157 (Kung), 7,005,406 (Kung et al.), 6,893,592 (Arrington et al.), and 6,897,183 (Arrington et al.), the disclosures of which are incorporated by reference.

Imaging and Thermal Transfer Assemblies

Thermal printing heads, which can be used to transfer dye from the dye donor elements of the invention, are available commercially. Representative examples include, for example, a Fujitsu Thermal Head FTP-040 MCSOO1, a TDK Thermal Head LV5416, or a Rohm Thermal Head KE 2008-F3.

A thermal dye transfer assembly of the invention comprises (a) a thermal transfer donor element of this invention as described above, and (b) a dye image-receiving element as described above, the dye image-receiving element being in a superposed relationship with the thermal transfer donor element so that the dye layer of that donor element is in contact with the dye image-receiving layer of the dye-image receiving element.

The assembly comprising these two elements may be pre-assembled as an integral unit when a monochrome image is to be obtained. This may be done by temporarily adhering the two elements together at their margins. After transfer, the dye image-receiving element is then peeled apart to reveal the transferred dye image and the transferred protective clear film.

When a three-color image is to be obtained, the assembly is formed on at least three occasions during the time when heat is applied by the thermal printing head. After the first dye is transferred, the elements are peeled apart. A second dye donor element (or another area of the donor element with a different dye patch) is then brought in register with the dye image-receiving element and the process is repeated. The third color is obtained in the same manner. Finally, a protective clear film is applied on top. This protective clear film can also be known as a "laminate" over a dye image.

For example, the thermally transferable clear film can be thermally transferred over the thermally transferred dye image using an imaging laser to provide a protective clear film or laminate.

The method of this invention can provide a multicolor thermal dye print having a protective overcoat disposed over the multicolor thermal dye image wherein the protective overcoat is provided from the thermal transferable clear film described herein.

In some embodiments, the method of this invention can be carried out using a thermal printer having one or two thermal print heads for thermal transfer of a dye image, a thermally transferable clear film, or a metal pattern or layer, and the thermal printer optionally comprises a rotatable carousel for moving the thermal transfer donor element in relation to the one or more thermal print heads.

When the protective clear film is applied, it can be patterned to provide a matte or glossy finish by varying thickness, line time, print energy, or some combination thereof. Further, expandable or pre-expanded beads can be used in the protective clear film to affect a gloss or matte finish depending on the amount and size of the beads. These protective clear films, whether patterned or not, can be provided over any colorant or dye image on, for example but not limited to, ink jet, thermal, or electrophotographic receivers, or silver halide prints.

The present invention provides at least the following embodiments and combinations thereof, but other combinations of features are considered to be within the present invention as a skilled artisan would appreciate from the teaching of this disclosure:

1. A thermal transfer donor element comprising a polymeric support having at least a portion thereof coated with a thermal transferable protective clear film that comprises a transparent poly(vinyl acetal) binder to which is attached silicone groups.

2. The thermal transfer donor element of embodiment 1 wherein the poly(vinyl acetal) binder comprises a silicone that is attached to the binder backbone through the reaction product of a hydroxyl group and an isocyanate-functionalized silicone having at least one reactive isocyanate group having the Structure:

—O—R—N=C=O.

3. The thermal transfer donor element of embodiment 1 or 2 wherein the poly(vinyl acetal) binder comprises a silicone that is attached through the reaction product of a hydroxyl group and an isocyanate-functionalized silicone that is represented by one or more of the following Structures ($SILICONE_1$), ($SILICONE_2$), and ($SILICONE_3$):

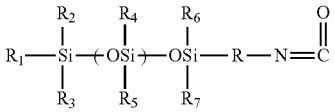

($SILICONE_1$)

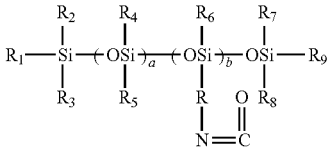

($SILICONE_2$)

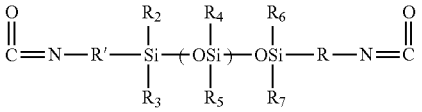

($SILICONE_3$)

wherein R and R' are the same or different aliphatic linking groups, $R_1$ through $R_9$ are the same or different alkyl, cycloalkyl, or phenyl groups, a and b are independently integers of 1 to 2000.

4. The thermal transfer donor element of any of embodiments 1 to 3 wherein the poly(vinyl acetal) binder having attached silicone groups is present in the thermal transferable protective clear film in an amount of at least 1 weight % and up to and including 100 weight %.

5. The thermal transfer donor element of any of embodiments 1 to 4 wherein the thermal transferable protective clear film further comprises: (a) an UV-absorbing light stabilizer that is a hydroxyphenyl triazine or an N-oxyl radical that is derived from a hindered amine, (b) a plasticizer, (c) a secondary polymeric binder that does not affect the thermal transferability of the thermal transferable protective clear film, (d) a surfactant, or (e) any combination of (a) through (d).

6. The thermal transfer donor element of embodiment 5 wherein the thermal transferable protective clear film further comprises a secondary polymeric binder that is selected from the group consisting of poly(vinyl benzal), poly(vinyl formal), poly(methyl methacrylate), and a styrene-allyl alcohol copolymer.

7. The thermal transfer donor element of any of embodiments 1 to 6 that is also a thermal dye transfer donor element and further comprises one or more patches of thermal yellow, cyan, magenta, or black image dyes dispersed within a polymeric binder.

8. The thermal transfer donor element of any of embodiments 1 to 7 wherein the thermal transferable protective clear film further comprises particulate materials in an amount of at least 0.1 weight % based on clear film dry weight.

9. The thermal transfer donor element of any of embodiments 1 to 8 further comprising a slip layer on the polymeric support opposite the thermal transferable protective clear film.

10. A thermal transfer assembly comprising the thermal transfer donor element of any of embodiments 1 to 9 in thermal association with a thermal dye transfer receiver element, 11. The thermal transfer assembly of embodiment 10 wherein the thermal transfer donor element further comprises one or more patches of thermal yellow, cyan, magenta, or black image dyes dispersed within a polymeric binder.

12. The thermal transfer assembly of embodiment 10 wherein the thermal transfer donor element comprises at least one patch of each of thermal yellow, cyan, magenta, and black image dyes, and at least one patch of the thermal transferable clear film.

13. A thermal transfer assembly comprising the thermal transfer donor element of any of embodiments 1 to 9 in thermal association with a receiver element.

14. A method for providing a protective overcoat on a thermal dye transfer receiver element comprising:

bringing the thermal transfer donor element of any of embodiments 1 to 9 into thermal association with a thermal dye transfer receiver element, thermally transferring the thermal transferable clear film from the thermal transfer donor element to the thermal dye transfer receiver element.

15. The method of embodiment 14 further comprising:

thermally transferring a dye image from a thermal transfer donor element comprising at least one thermal image dye patch, and thermally transferring the thermal transferable clear film over the thermally transferred dye image to provide a protective overcoat.

16. The method of embodiment 14 or 15 thermally transferring the thermally transferable clear film over the thermally transferred dye image using an imaging laser.

17. The method of any of embodiments 14 to 16 being carried out in a thermal printer having one or two thermal print heads for thermal transfer of a dye image, a thermally transferable clear film, or a metal pattern or layer, and the thermal printer optionally comprises a rotatable carousel for moving the thermal transfer donor element in relation to the one or more thermal print heads.

18. The method of any of embodiments 14 to 17 for providing a multicolor thermal dye print having a protective overcoat disposed over the multicolor thermal dye image, the protective overcoat being provided from the thermal transferable clear film.

19. A method for providing a protective overcoat on a receiver element comprising:

bringing the thermal transfer donor element of any of embodiments 1 to 9 into thermal association with a receiver element, thermally transferring the thermal transferable clear film from the thermal transfer donor element to the receiver element.

The following Examples are provided to illustrate the practice of this invention and are not meant to be limiting in any manner.

The silicone-based material with reactive isocyanate group used as a reactant in the Examples is commercially available from Siltech Corporation as Silmer NCO Di 50 and has a general chemical structure shown as follows.

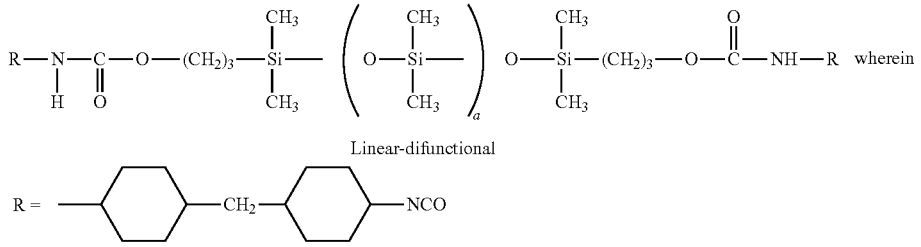

The polyvinyl acetal) used in the Invention Examples and Comparative Examples was obtained from Sekisui corporation as KS-10.

Other materials used in the Invention Examples and Comparative Examples include the following:

Colloidal silica dispersed in isopropanol commercially available from Nissan Chemicals as IPA-ST.

DEK refers to diethylene ketone.

Poly(divinyl benzene) beads (about 4 μm average diameter).

UV light absorber of the hydroxyphenyl-triazine class commercially is available from CIBA as Tinuvin® 460.

A poly(vinyl acetal) binder having attached silicone groups was prepared as follows:

A 1-liter three neck flask equipped with a Teflon paddle stirrer, heating mantle with controller and thermometer and reflux condenser was purged with nitrogen and then charged with 340 grams of diethylene ketone (DEK). Then 160 grams of KS-10, previously dried at 50 C for two days, was slowly added to the solvent. With stirring at 250 rpm, the mixture was heated to 75° C., held for 15 minutes, and cooled to room temperature to obtain a clear solution. At this time, 16 grams of silicone-based material with reactive isocyanate groups, Silmer NCO Di 50, was added to this solution, stirred for 5 minutes at 250 rpm at room temperature and heated to 75° C. and held there for 6 hours to carry out the attachment of the silicone to the poly(vinyl acetal). Upon cooling to room temperature, the reaction product was evaluated by IR analysis and the reaction was considered to be complete. The poly (vinyl acetal) binder with attached silicone groups thus was prepared for formulation of the Invention Examples and is referred to as KS-10+Silmer NCO Di 50.

INVENTION AND COMPARATIVE EXAMPLES

The substrate used for the Invention and Comparative Examples was a 4.5 μm thick polyethylene terephthalate (PET) support that had been previously coated on one side with a subbing layer of titanium alkoxide and a silicone-free slipping layer as described in U.S. Pat. No. 7,501,382 B2 (Foster et al., slip layer in Invention Example 2, Col. 32, lines 37-62). A number of formulations as described below in TABLE I were prepared and coated on a sample of the support (on the side opposite the slipping layer) by a direct gravure method at a 61 ml/min coating speed and dried at 82° C. Each of these coatings was thermally transferred as a thermally transferable protective clear film to a $D_{max}$ print to provide a protective overcoat, which was evaluated (as described below) for the scratch resistance.

TABLE I

| (wet formulation in grams) | | | | |
|---|---|---|---|---|
| | Comparative Example 1 (no silicone) | Invention Example 1 | Invention Example 2 | Invention Example 3 |
| KS-10 | 33.25 | | 8.31 | 16.63 |
| Poly (divinyl benzene) beads | 5.60 | 5.60 | 5.60 | 5.60 |
| IPA-ST (30% in IPA) | 80.91 | 80.91 | 80.91 | 80.91 |
| Tinuvin ® 460 | 5.65 | 5.65 | 5.65 | 5.65 |
| KS-10 + Silmer NCO Di 50 (44.88% in DEK) | | 74.09 | 55.57 | 37.05 |
| DEK | 174.59 | 133.75 | 143.96 | 154.16 |
| Total | 300 | 300 | 300 | 300 |
| Dry Coverage (mg/m$^2$) | | | | |
| KS-10 | 633.91 | | 158.45 | 316.96 |
| Poly (divinyl benzene) beads | 106.78 | 106.78 | 106.78 | 106.78 |
| IPA-ST | 462.76 | 462.76 | 462.76 | 462.76 |
| Tinuvin ® 460 | 107.64 | 107.64 | 107.64 | 107.64 |
| KS-10 + Silmer NCO Di 50 | | 633.91 | 475.46 | 316.95 |
| Total | 1311.09 | 1311.09 | 1311.09 | 1311.09 |

In order to assess the mobility of silicone in the coated layers, transfer of silicone from the coated side to the backside (slipping layer side) was evaluated. This was accomplished by washing the backside of the Invention and Comparative Example coated samples with hexane and quantitatively measuring the silicone content of the resulting wash solution by NMR. The results are listed below in TABLE II. Transferred silicone levels of less than or equal to 0.5 mg/m$^2$ are indicative of the non-migratory nature of the attached silicone moieties and are highly desired.

$D_{max}$ prints were created in a mechanized version of the Kodak® Photo Printer 6850 using commercially available thermal dye transfer receiving paper Kodak XtraLife® paper and thermal dye donor ribbon Kodak Professional EKTATHERM® ribbon (catalogue number 106-7347), patchwise thermally coated with cyan, magenta, and yellow dyes in a cellulose acetate propionate binder. After thermally transferring the dyes from the dye donor ribbon to the thermal dye transfer receiving paper, each $D_{max}$ print was further provided with a protective overcoat by thermally transferring each clear film of the Invention and Comparative Examples.

The $D_{max}$ print having the protective overcoat was then evaluated for scratch resistance using a balanced beam scrape adhesion and Mar Tester (ASTM D2197). In this test, the $D_{max}$ prints were scratched by dragging a tungsten carbide tipped stylus (with an edge radius of 375 μm) at a tip angle of 30° (with respect to the normal) at a speed of 50.8 mm/second under varying loads over the surface of each $D_{max}$ print. The load was varied in 10 gram increments up to 1000 grams until a visible white scratch was barely noticed on the black background of the $D_{max}$ print. The load at which the visible white scratch appeared is reported. Clearly, the higher the load the more scratch-resistant is the protective overcoat. The procedure was repeated along the printing direction and the cross direction for each $D_{max}$ print and the results are shown below in TABLE II.

TABLE II

| Sample | Silicone transfer from coated side to backside ($mg/m^2$) | Load for visible scratch (grams) Print direction | Load for visible scratch (grams) Cross direction |
|---|---|---|---|
| Comparative Example 1 (no silicone) | None detected | 170 | 200 |
| Invention Example 1 | 0.32 | >1000 | >1000 |
| Invention Example 2 | 0.32 | >1000 | >1000 |
| Invention Example 3 | 0.22 | >1000 | >1000 |

From the data shown in TABLE II, it is clear that Invention Examples 1-3, prepared in accordance with the present invention provided superior scratch resistance (higher load for visible scratch) when compared with Comparative Example 1 that contained no silicone. In addition, the Invention Examples exhibited minimal silicone transfer (less than 0.5 $mg/m^2$) from the coated protective clear film. This property is highly desirable to reduce contamination of other surfaces during normal manufacturing and printing operations, or during handling and use by customers.

The invention has been described in detail with particular reference to certain preferred embodiments thereof, but it will be understood that variations and modifications can be effected within the spirit and scope of the invention.

The invention claimed is:

1. A thermal transfer donor element comprising a polymeric support having at least a portion thereof coated with a thermal transferable protective clear film that comprises a transparent poly(vinyl acetal) binder to which is attached silicone groups.

2. The thermal transfer donor element of claim 1 wherein the poly(vinyl acetal) binder comprises a silicone that is attached to the binder backbone through the reaction product of a hydroxyl group and an isocyanate-functionalized silicone having at least one reactive isocyanate group having the Structure:

—O—R—N=C=O.

3. The thermal transfer donor element of claim 1 wherein the poly(vinyl acetal) binder comprises a silicone that is attached through the reaction product of a hydroxyl group and an isocyanate-functionalized silicone that is represented by one or more of the following Structures ($SILICONE_1$), ($SILICONE_2$), and ($SILICONE_3$):

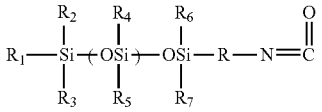

($SILICONE_1$)

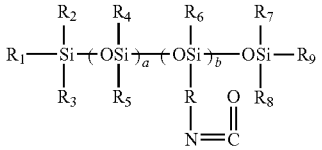

($SILICONE_2$)

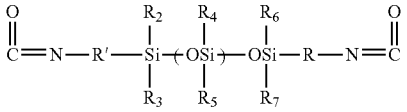

($SILICONE_3$)

wherein R and R' are the same or different aliphatic linking groups, $R_1$ through $R_9$ are the same or different alkyl, cycloalkyl, or phenyl groups, a and b are independently integers of 1 to 2000.

4. The thermal transfer donor element of claim 1 wherein the poly(vinyl acetal) binder having attached silicone groups is present in the thermal transferable protective clear film in an amount of at least 1 weight % and up to and including 100 weight %.

5. The thermal transfer donor element of claim 1 wherein the thermal transferable protective clear film further comprises: (a) an UV-absorbing light stabilizer that is a hydroxyphenyl triazine or an N-oxyl radical that is derived from a hindered amine, (b) a plasticizer, (c) a secondary polymeric binder that does not affect the thermal transferability of the thermal transferable protective clear film, (d) a surfactant, or (e) any combination of (a) through (d).

6. The thermal transfer donor element of claim 5 wherein the thermal transferable protective clear film further comprises a secondary polymeric binder that is selected from the group consisting of poly(vinyl benzal), poly(vinyl formal), poly(methyl methacrylate), and a styrene-allyl alcohol copolymer.

7. The thermal transfer donor element of claim 1 that is also a thermal dye transfer donor element and further comprises one or more patches of thermal yellow, cyan, magenta, or black image dyes dispersed within a polymeric binder.

8. The thermal transfer donor element of claim 1 wherein the thermal transferable protective clear film further comprises particulate materials in an amount of at least 0.1 weight % based on clear film dry weight.

9. The thermal transfer donor element of claim 1 further comprising a slip layer on the polymeric support opposite the thermal transferable protective clear film.

10. A thermal transfer assembly comprising the thermal transfer donor element of claim 1 in thermal association with a thermal dye transfer receiver element.

11. The thermal transfer assembly of claim 10 wherein the thermal transferable clear film of the thermal transfer donor element comprises a poly(vinyl acetal) binder comprises a silicone that is attached through the reaction product of a hydroxyl group and an isocyanate-functionalized silicone that is represented by one or more of the following Structures ($SILICONE_1$), ($SILICONE_2$), and ($SILICONE_3$):

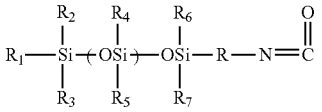

(SILICONE$_1$)

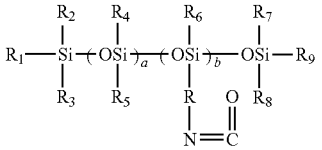

(SILICONE$_2$)

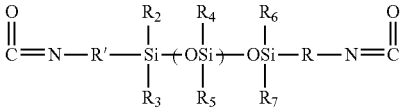

(SILICONE$_3$)

wherein R and R' are the same or different aliphatic linking groups, $R_1$ through $R_9$ are the same or different alkyl, cycloalkyl, or phenyl groups, a and b are independently integers of 1 to 2000.

12. The thermal transfer assembly of claim 10 wherein the thermal transfer donor element further comprises one or more patches of thermal yellow, cyan, magenta, or black image dyes dispersed within a polymeric binder.

13. The thermal transfer assembly of claim 10 wherein the thermal transfer donor element comprises at least one patch of each of thermal yellow, cyan, magenta, and black image dyes, and at least one patch of the thermal transferable clear film.

14. A thermal transfer assembly comprising the thermal transfer donor element of claim 1 in thermal association with a receiver element.

15. A method for providing a protective overcoat on a thermal dye transfer receiver element comprising:

bringing the thermal transfer donor element of claim 1 into thermal association with a thermal dye transfer receiver element, thermally transferring the thermal transferable clear film from the thermal transfer donor element to the thermal dye transfer receiver element.

16. The method of claim 15 further comprising:

thermally transferring a dye image from a thermal transfer donor element comprising at least one thermal image dye patch, and thermally transferring the thermal transferable clear film over the thermally transferred dye image to provide a protective overcoat.

17. The method of claim 16 thermally transferring the thermally transferable clear film over the thermally transferred dye image using an imaging laser.

18. The method of claim 15 being carried out in a thermal printer having one or two thermal print heads for thermal transfer of a dye image, a thermally transferable clear film, or a metal pattern or layer, and the thermal printer optionally comprises a rotatable carousel for moving the thermal transfer donor element in relation to the one or more thermal print heads.

19. The method of claim 15 for providing a multicolor thermal dye print having a protective overcoat disposed over the multicolor thermal dye image, the protective overcoat being provided from the thermal transferable clear film.

20. A method for providing a protective overcoat on a receiver element comprising:

bringing the thermal transfer donor element of claim 1 into thermal association with a receiver element, thermally transferring the thermal transferable clear film from the thermal transfer donor element to the receiver element.

* * * * *